US007537551B2

(12) United States Patent
Steffee

(10) Patent No.: US 7,537,551 B2
(45) Date of Patent: May 26, 2009

(54) BIDIRECTIONAL RESISTANCE APPARATUS FOR EXERCISE EQUIPMENT

(75) Inventor: Clay Steffee, Alexandria, KY (US)

(73) Assignee: Brunswick Corporation, Lake Forest, IL (US)

( * ) Notice: Subject to any disclaimer, the term of this patent is extended or adjusted under 35 U.S.C. 154(b) by 191 days.

(21) Appl. No.: 11/625,436

(22) Filed: Jan. 22, 2007

(65) Prior Publication Data

US 2008/0176722 A1 Jul. 24, 2008

(51) Int. Cl.
*A63B 21/062* (2006.01)
*A63B 23/04* (2006.01)

(52) U.S. Cl. ..... 482/100; 482/137

(58) Field of Classification Search ..... 482/92–94, 482/100, 136–138, 905; 273/451, 452
See application file for complete search history.

(56) References Cited

U.S. PATENT DOCUMENTS

| | | | | | |
|---|---|---|---|---|---|
| 319,686 | A | | 6/1885 | Farmer | |
| 3,089,700 | A | * | 5/1963 | Hotas | 482/94 |
| 4,456,245 | A | * | 6/1984 | Baldwin | 482/136 |
| 4,600,189 | A | * | 7/1986 | Olschansky et al. | 482/100 |
| 4,621,807 | A | * | 11/1986 | Stramer | 482/100 |
| 4,709,919 | A | | 12/1987 | Cano | |
| 4,944,511 | A | | 7/1990 | Francis | |
| 5,058,884 | A | | 10/1991 | Fuller, Sr. | |
| 5,067,708 | A | | 11/1991 | Oschansky et al. | |
| 5,102,121 | A | * | 4/1992 | Solow et al. | 482/94 |
| 5,154,684 | A | | 10/1992 | Delf | |
| 5,190,509 | A | * | 3/1993 | Davison, Jr. | 482/100 |
| 5,242,344 | A | | 9/1993 | Hundley | |
| 5,308,304 | A | | 5/1994 | Habing | |
| 5,354,252 | A | | 10/1994 | Habing | |
| 5,380,258 | A | | 1/1995 | Hawley, Jr. | |
| 5,466,204 | A | * | 11/1995 | Nearing | 482/102 |
| 5,468,202 | A | | 11/1995 | Habing | |
| 5,509,878 | A | | 4/1996 | Denega et al. | |
| 5,667,465 | A | * | 9/1997 | McCollum et al. | 482/100 |
| 5,722,921 | A | * | 3/1998 | Simonson | 482/100 |
| 5,810,698 | A | * | 9/1998 | Hullett et al. | 482/96 |
| 5,885,193 | A | | 3/1999 | Habing et al. | |
| 6,302,833 | B1 | * | 10/2001 | Ellis et al. | 482/100 |
| 6,338,701 | B1 | | 1/2002 | Webber | |
| 6,592,498 | B1 | | 7/2003 | Trainor | |
| 7,029,426 | B1 | | 4/2006 | Fuller, Sr. | |
| 7,396,319 | B1 | * | 7/2008 | Ellis | 482/100 |
| 2003/0096681 | A1 | | 5/2003 | Myers et al. | |
| 2006/0094571 | A1 | | 5/2006 | Polidi | |
| 2006/0199708 | A1 | | 9/2006 | Alessandri et al. | |

FOREIGN PATENT DOCUMENTS

JP 2006122499 A * 5/2006

* cited by examiner

*Primary Examiner*—Loan H Thanh
*Assistant Examiner*—Victor K Hwang
(74) *Attorney, Agent, or Firm*—Hanley, Flight & Zimmerman, LLC

(57) ABSTRACT

Bidirectional resistance apparatus for exercise equipment are disclosed. An example exercise apparatus comprises a resistance source coupled to a cable between first and second ends of the cable, a rotational resistance mechanism coupled to the first and second ends of the cable, and an exercise arm coupled to the rotational resistance mechanism to rotate in first and second directions, the rotational resistance mechanism to apply a substantially constant resistance to the exercise arm when the exercise arm is rotated in the first and second directions.

25 Claims, 7 Drawing Sheets

BIDIRECTIONAL RESISTANCE APPARATUS FOR EXERCISE EQUIPMENT

FIELD OF THE DISCLOSURE

This disclosure relates generally to exercise equipment and, more particularly, to bidirectional resistance apparatus for exercise equipment.

BACKGROUND

Some types of exercise equipment utilize, implement and/or provide bidirectional movements and/or exercises. For example, a hip exercise machine may implement hip flexion, hip extension, hip abduction and/or hip adduction movements for both hips. Similarly, a leg exercise machine may implement both leg extension and leg curl movements for either leg. In such bidirectional exercise machines, resistance is required for two directions of rotation (e.g., clockwise and counterclockwise).

DETAILED DESCRIPTION

Bidirectional resistance apparatus for exercise equipment are disclosed. A disclosed example exercise apparatus includes a resistance source coupled to a cable between first and second ends of the cable, a rotational resistance mechanism coupled to the first and second ends of the cable, and an exercise arm coupled to the rotational resistance mechanism to rotate in first and second directions, the rotational resistance mechanism to apply a substantially constant resistance to the exercise arm when the exercise arm is rotated in the first and second directions.

A disclosed example bidirectional resistance apparatus for use with an exercise machine includes a cable, a first pulley rotatable about an axis, a first end of the cable attached to the first pulley at a first side of the bidirectional resistance apparatus, a second pulley rotatable about the axis, a second end of the cable attached to the second pulley at a second side of the bidirectional resistance apparatus, and an exercise arm rotatable about the axis to rotate the first pulley when the exercise arm is rotated in a first direction and to rotate the second pulley when the exercise arm is rotated in a second direction.

Figure 1:
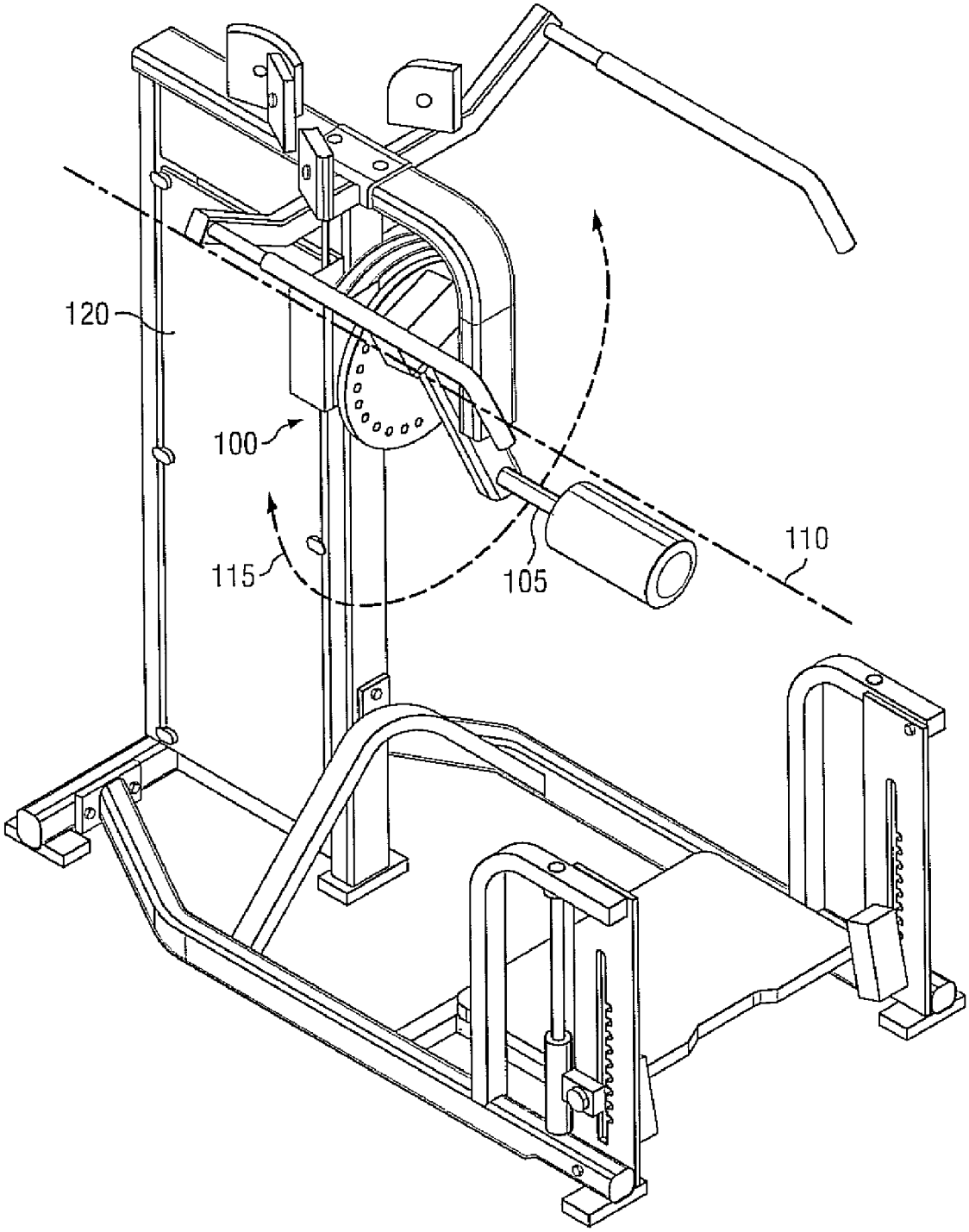
FIG. 1 is an illustration of an example exercise machine having a bidirectional resistance mechanism constructed in accordance with the teachings of the invention.

FIG. 1 illustrates an example exercise machine having a bidirectional resistance mechanism 100 that provides bidirectional resistance to a rotatable exercise arm 105. The example exercise machine of FIG. 1 enables a person using the exercise machine to perform, for either hip (i.e., bilateral), any number of hip exercises, such as hip flexions, hip extensions, hip abductions and/or hip adductions. While the example bidirectional resistance mechanism 100 is described with reference to the example exercise machine of FIG. 1, persons of ordinary skill in the art will readily appreciate that the bidirectional resistance mechanism 100 can be implemented for any number and/or type(s) of exercise machines such as, for example, a combination leg extension and leg curl exercise machine. Moreover, while an axis of rotation 110 for the example exercise arm 105 and the example bidirectional resistance mechanism 100 is substantially horizontal in the example of FIG. 1, the example bidirectional resistance mechanism 100 can be implemented to provide an axis of rotation 110 having other orientations (e.g., vertical, 45 degrees, etc.).

The example bidirectional resistance mechanism 100 of FIG. 1 provides substantially constant resistance to the exercise arm 105 throughout its range of rotational motion 115. Additionally, the example bidirectional resistance mechanism 100 provides the substantially constant resistance after substantially zero rotation of the rotatable exercise arm 105 in either rotation direction (e.g., clockwise and/or counterclockwise). Example views that illustrate an example manner of implementing the bidirectional resistance mechanism 100 of FIG. 1 are described below in connection with FIGS. 2, 3, 4, 5, 6 and 7.

To provide a source of resistance (i.e., a resistance source), the example exercise machine of FIG. 1 includes a weight stack 120. However, any other types of resistance sources can be used such as, for example, an elastic resistance. As described below in connection with FIG. 2, the example bidirectional resistance mechanism 100 of FIG. 1 couples the resistance provided by the weight stack 120 to the exercise arm 105.

Other elements (e.g., platform, support members, handholds, pads, etc.) of the example exercise machine of FIG. 1 are self-evident and/or self-explanatory to persons of ordinary skill in the art and, thus, in the interest of brevity, are not discussed further herein. Moreover, the implementation, location and/or form of such elements necessarily depend upon the type(s) of exercise machines being implemented.

FIGS. 2-7 illustrate example views of the example bidirectional resistance mechanism 100 of FIG. 1 taken from different views and/or perspectives. For ease of understanding, like elements in FIGS. 1-7 have been numbered with like reference numerals. Such like reference numbering allows for easy cross-referencing amongst the various views illustrated in FIGS. 2-7 and eliminates the need for redundant and/or repetitive explanation of such identical elements. Each of the various aspects of the example bidirectional resistance mechanism 100 of FIGS. 1-7 will be described with reference to at least one of the example views of FIGS. 2-7. However, a particular element may not be discussed in connection with a particular view. In such cases, the interested reader is referred to the descriptions of the particular element presented in connection with another of the example views. In the illustrated views of FIGS. 2-7, various elements of the exercise machine of FIG. 1 (e.g., mounting members, frame members, housings, etc.) have been omitted to best illustrate and/or to better facilitate the description and/or understanding of the example bidirectional resistance mechanism 100.

Figure 2:
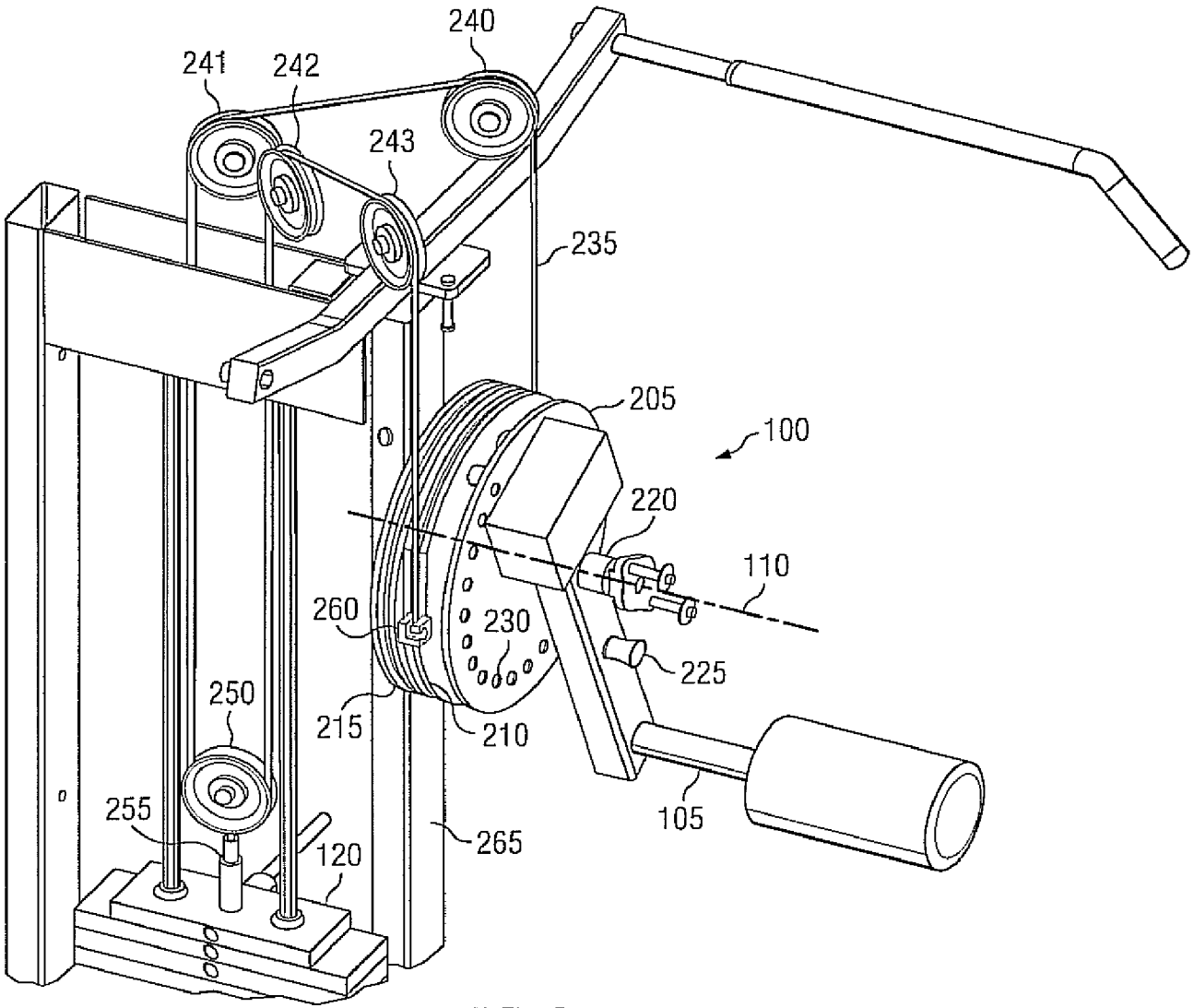
FIGS. 2, 3, 4, 5, 6 and 7 illustrate different views of the example bidirectional resistance mechanism of FIG. 1.
Figure 3:
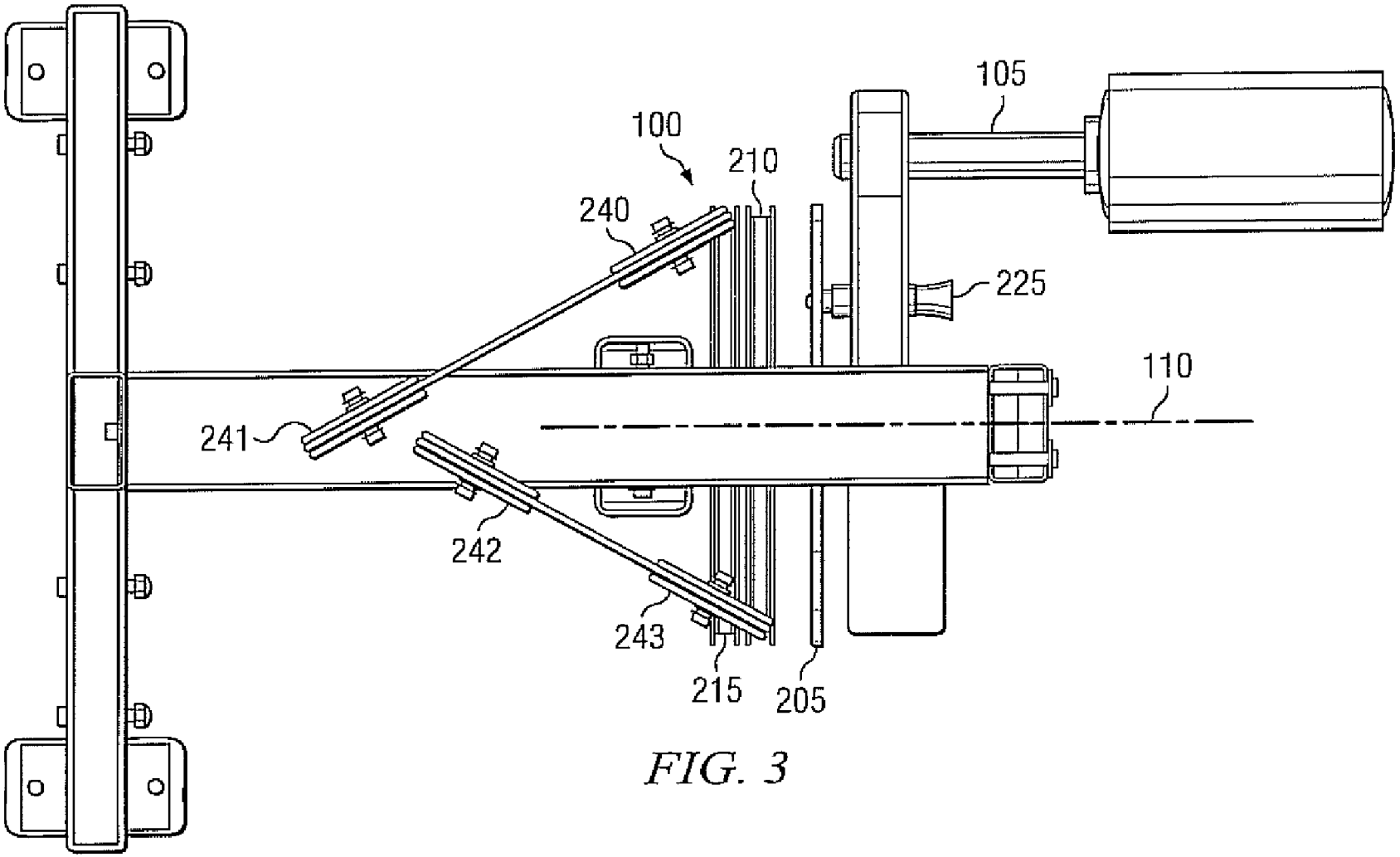
Figure 4:
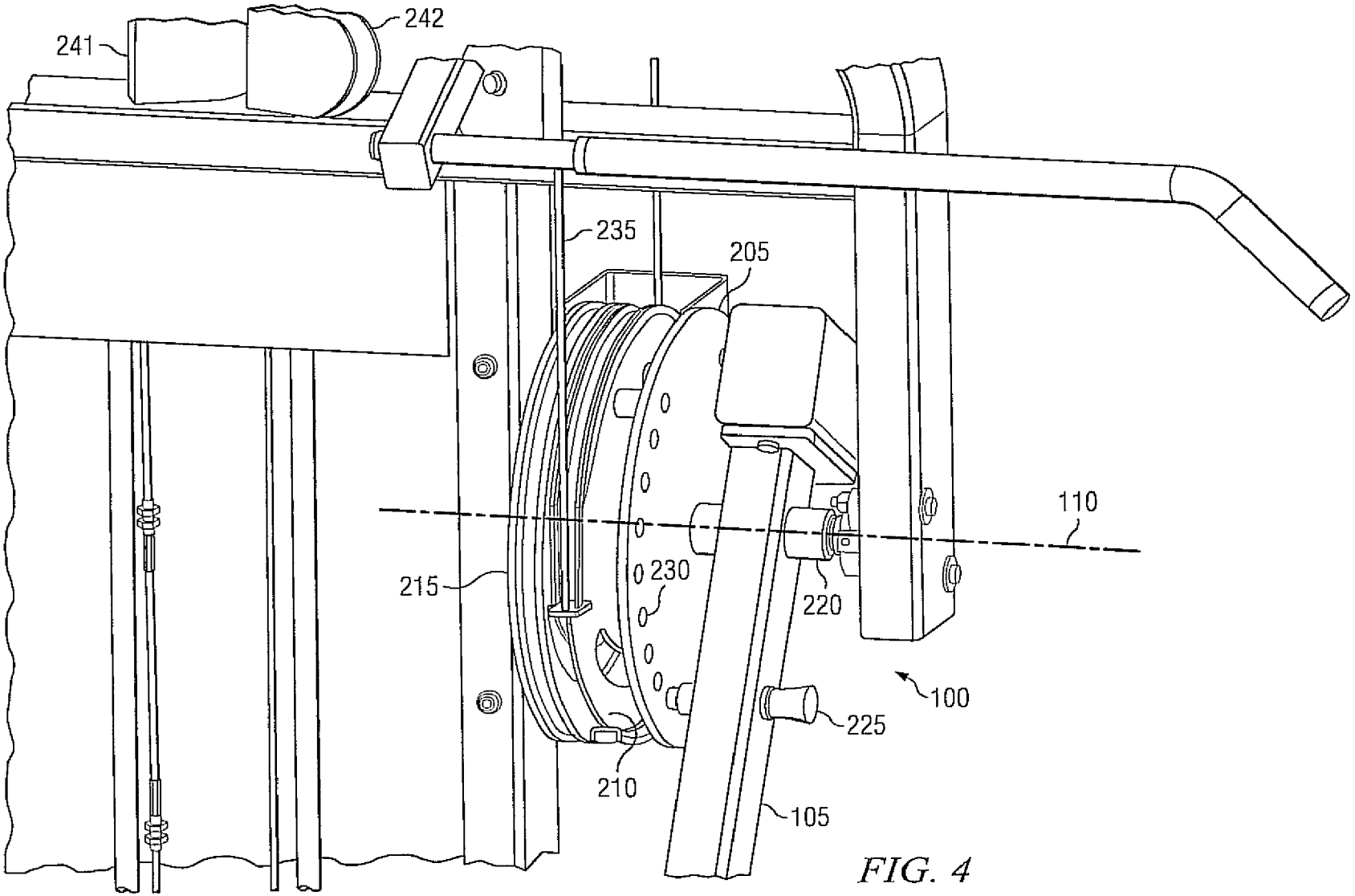

As illustrated in FIG. 2, the example bidirectional resistance mechanism 100 includes a selector plate 205, a first rotatable member 210, and a second rotatable member 215 that rotate about the axis 110 on a shaft 220. The rotatable members 210 and 215 are rotatably coupled to the shaft 220 (i.e., the members 210 and 215 can rotate freely relative to the shaft 220). The example exercise arm 105 attaches to the example shaft 220 to couple the exercise arm 105 to the bidirectional resistance mechanism 100. The rotatable members 210 and 215 may be implemented as pulleys as depicted in FIGS. 2-7 and/or may be implemented as discs or other rotatable members suitable to move a cable attached to a source of resistance. The example view of FIG. 3 illustrates the example bidirectional resistance mechanism 100 from the top of the example exercise machine, and the example view of FIG. 4 illustrates the example bidirectional resistance mechanism 100 in more detail.

To position the exercise arm 105, the example bidirectional resistance mechanism 100 includes a selector pin 225 and the example selector plate 205 includes a plurality of circumferentially spaced holes 230. By inserting the example selector pin 225 through the exercise arm 105 into one of the example holes 225, the exercise arm 105 can be rotatably positioned (e.g., set to a desired angular position) relative to the bidirectional resistance mechanism 100 (i.e., define at rest position for the exercise arm 105). From its at rest position, the exercise arm 105 presents a substantially constant resistance when rotated in either direction.

To provide and/or apply a resistive force to the exercise arm 105, the example bidirectional resistance mechanism 100 includes a cable 235, one or more guide pulleys (four of which are illustrated with reference numerals 240, 241, 242 and 243), a coupling pulley 250 and a coupler 255. A first end 260 of the example cable 235 is attached to the first rotatable member or pulley 210 at a first side of the bidirectional resistance mechanism 100. An opposite end 705 (FIG. 7) of the example cable 235 is attached to the second rotatable member or pulley 215 at an opposite side of the bidirectional resistance mechanism 100. As illustrated, the cable 235 is routed from the bidirectional resistance mechanism 100 to the coupling pulley 250 via the guide pulleys 240-243. The example coupling pulley 250 and the example coupler 255 collectively transfer force between a resistance source (e.g., the example weight stack 120) and the example cable 235.

As the exercise arm 105 is rotated by a user in a particular direction (e.g., counterclockwise) the selector plate 205 rotates in the same direction (e.g., counterclockwise). As described below in connection with FIGS. 5-7, depending upon the direction of rotation from the at rest position of the selector plate 205, either the first pulley 210 or the second pulley 215 is rotated. For example, when the selector plate 205 is rotated counterclockwise from the at rest position, the first pulley 210 rotates counterclockwise. During such a rotation of the first pulley 210, the second pulley 215 remains at rest against a stop 530 (FIG. 5) on a frame member 265. As the first pulley 210 rotates counterclockwise, the cable 235 is wrapped around the first pulley 210, thereby lifting the weight stack 120. As the selector plate 205 is rotated clockwise back towards the at rest position, the first pulley 210 is rotated clockwise thereby unwrapping the cable 235 and moving the weight stack 120 back towards its at rest position. Likewise, if the selector plate 205 is rotated clockwise from the at rest position the second pulley 215 is rotated clockwise causing the cable to be wrapped around the second pulley 215 thereby lifting the weight stack 120. Meanwhile, the first pulley 210 remains at rest against a second stop 525 (FIG. 5) attached to the frame member 265.

Figure 5:
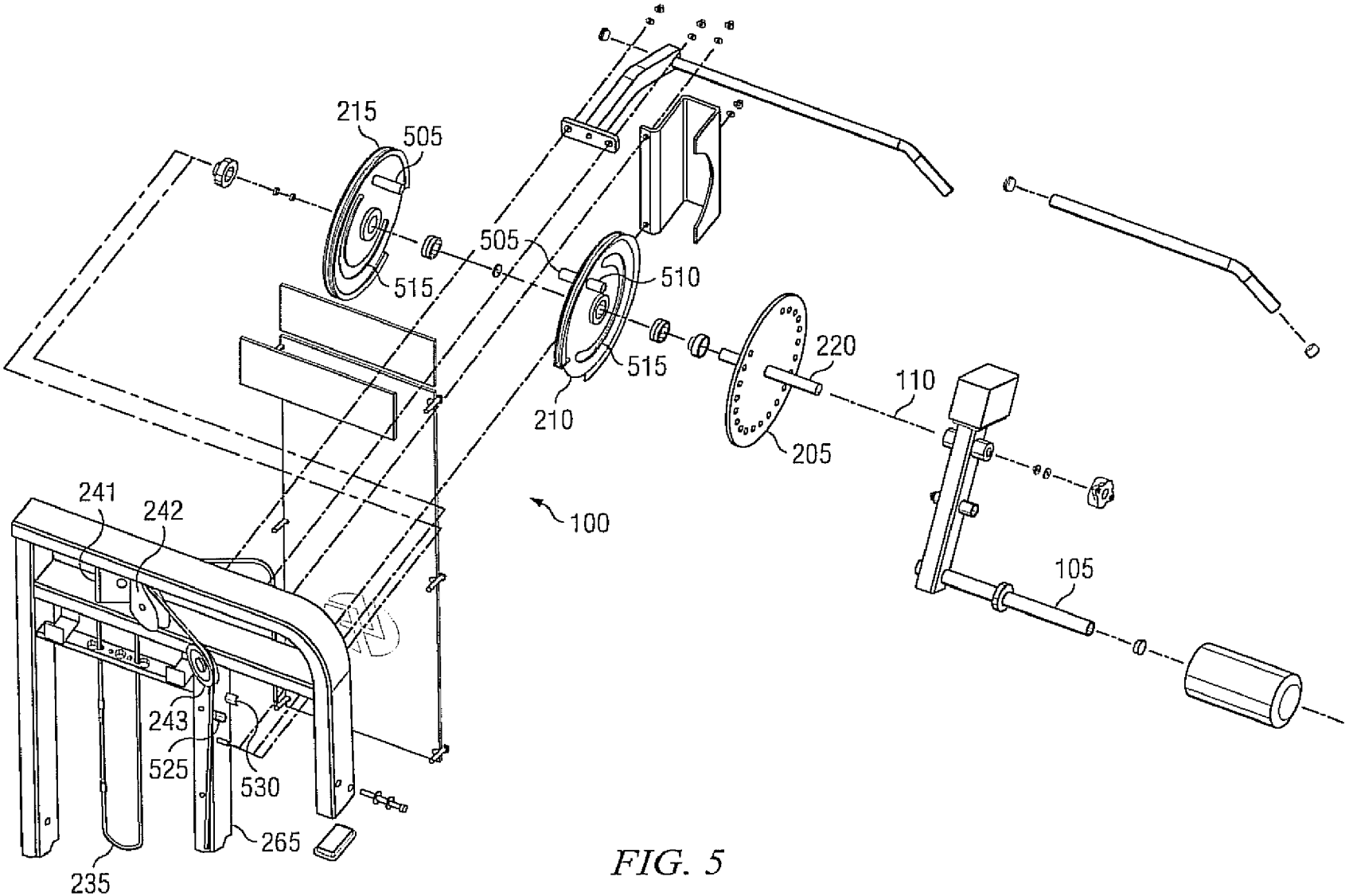

FIG. 5 illustrates an exploded view of the example bidirectional resistance mechanism 100 of FIGS. 1-4. As illustrated in FIG. 5, the example shaft 220 is implemented as a part of the example selector plate 205. The exercise arm 105 and the example pulleys 210 and 215 are mounted to rotate about the shaft 220. The example pulleys 210 and 215 are substantially identical and are mounted on the shaft 220 in opposite facing directions as shown in FIG. 5.

To allow the pulleys 210 and 215 to be rotated and/or prevented from rotating, each of the pulleys 210 and 215 has a first protrusion 505 on a first side of the pulley 210, 215 and a second protrusion 510 on a second side of the pulley 210, 215. To allow the first protrusions 505 to pass through the other pulley 210, 215 when the bidirectional resistance mechanism 100 is assembled, each of the pulleys 210 and 215 includes a slot 515. The example slot 515 of a pulley 210, 215 allows the first protrusion 505 of the other pulley 210, 215 to pass through the pulley 210, 215 and allows the pulleys 210 and 215 to rotate independently. The example protrusions 505 are longer than the example protrusions 510 to accommodate the thickness of and/or the space between the example pulleys 210 and 215.

As described in more detail below in connection with FIGS. 6 and 7, the protrusion 505 of the first pulley 210 and the protrusion 510 of the second pulley 215 have corresponding stops 525 and 530 that are mounted to the frame member 265. In particular, the example stop 525 acts against the first protrusion 505 of the first pulley 210 to prevent the first pulley 210 from rotatable clockwise beyond its at rest position, and the example stop 530 acts against the second protrusion 510 of the second pulley 215 to prevent the second pulley 215 from rotatable counterclockwise beyond its at rest position.

Figure 6:
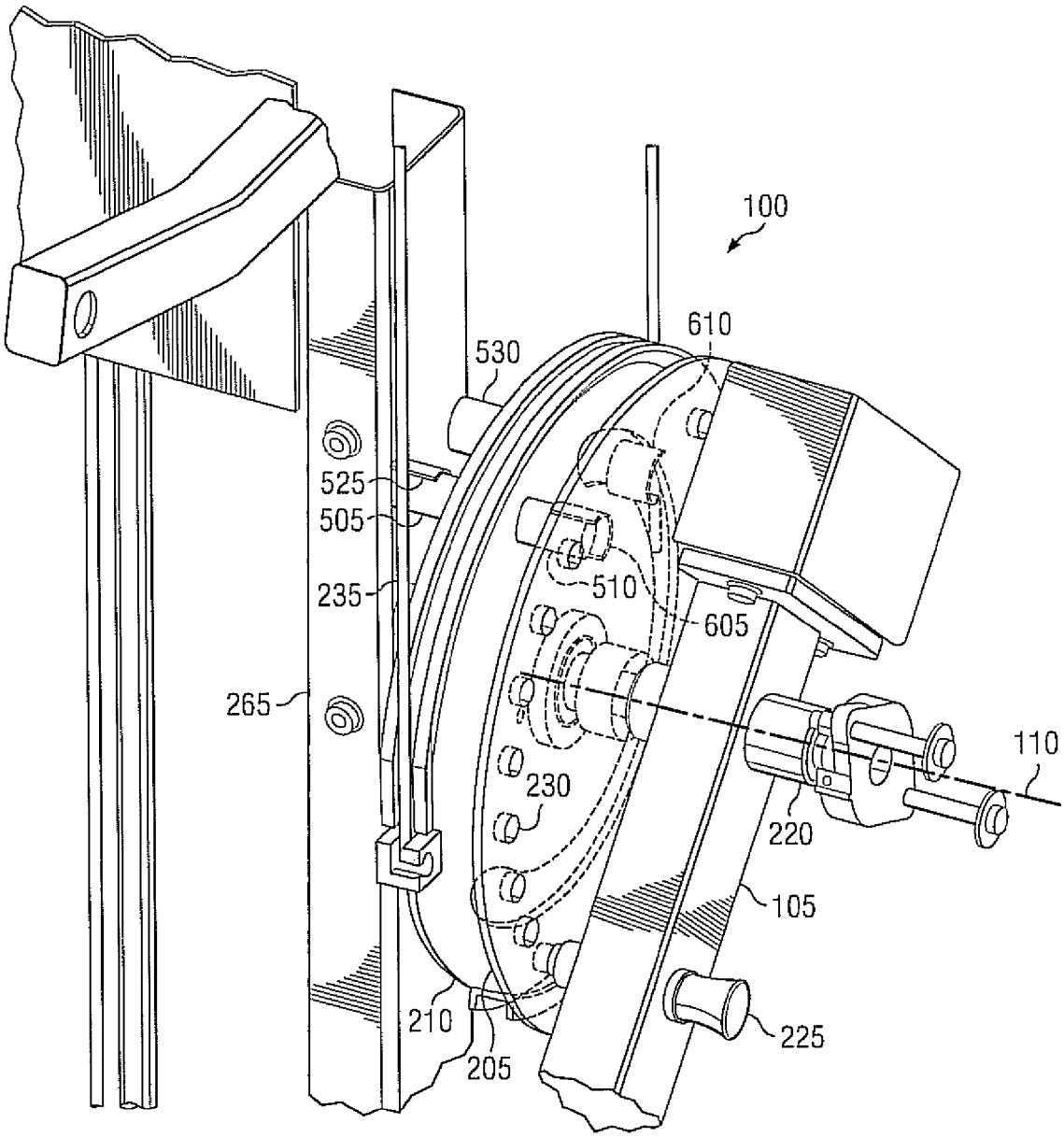
Figure 7:
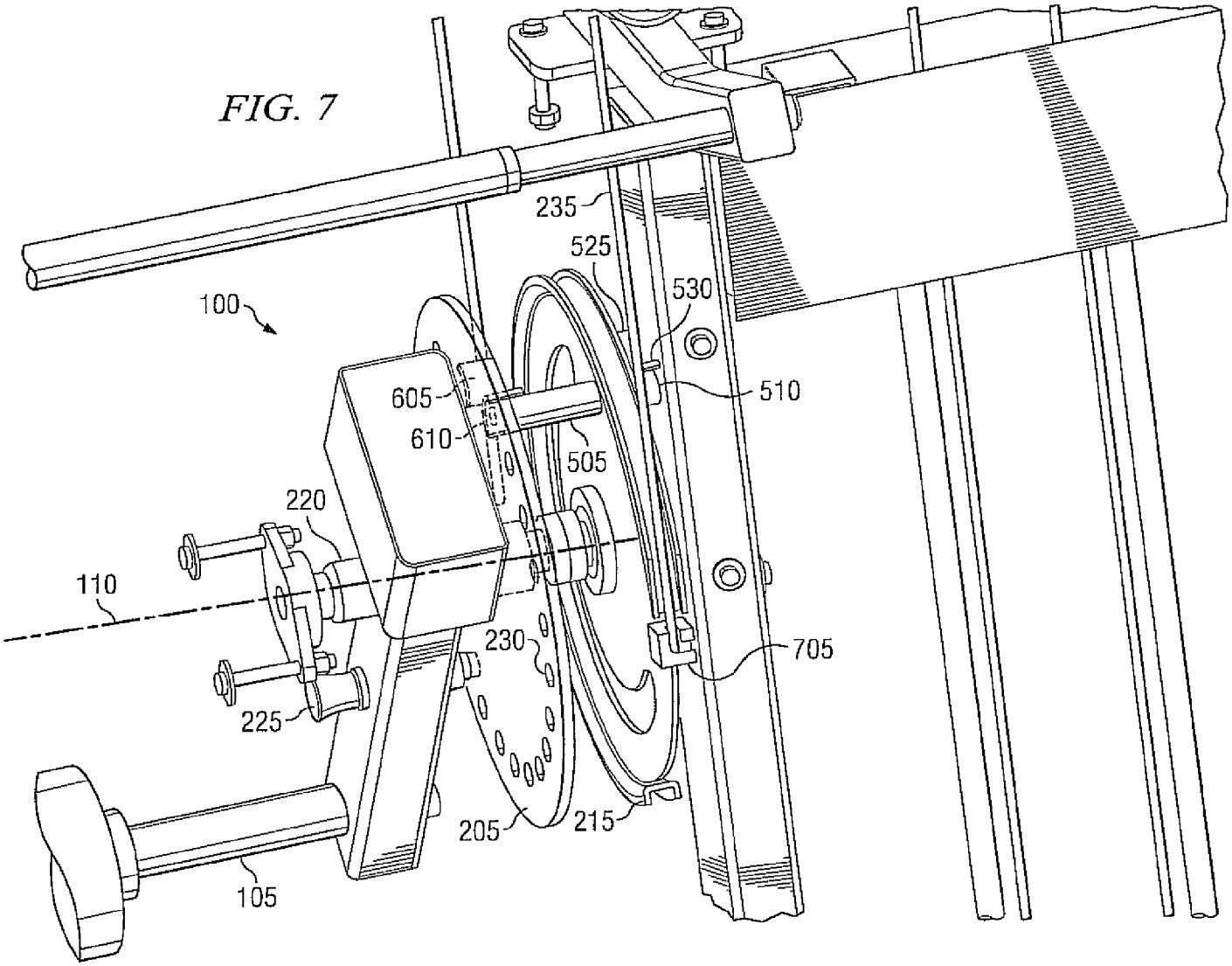

FIGS. 6 and 7 are views of the example bidirectional resistance mechanism 100 that illustrate how the example selector plate 205 acts to rotate the example pulleys 210 and 215. To exert a force on the pulleys 210 and 215, the example selector plate 205 includes stops 605 and 610. When the selector plate 205 is rotated counterclockwise from its at rest position, the example stop 605 acts against the second protrusion 510 of the first pulley 210 causing the first pulley 210 to rotate counterclockwise. Meanwhile, the example stop 530 mounted to the frame member 265 acts against the first protrusion 505 of the second pulley 215 (not shown) to prevent the second pulley 215 from rotating so that the second pulley 215 remains at rest against the stop 530. Likewise, when the selector plate 205 is rotated such that the stop 605 is spaced clockwise from the second protrusion 510 of the first pulley 210, the stop 525 mounted to the frame member 265 acts against the first protrusion 505 of the first pulley 210 to prevent the first pulley 210 from rotatable clockwise beyond its at rest position. The selector plate 205 can similarly engage the example stop 610 against the first protrusion 505 of the second pulley 215 to cause the second pulley 215 to rotate clockwise.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally and/or under the doctrine of equivalents.

What is claimed is:

1. An exercise apparatus comprising:

a resistance source coupled to a cable between first and second ends of the cable;

a rotational resistance mechanism comprising:

a shaft;

a first rotatable member rotatable about the shaft and coupled to the first end of the cable, the first rotatable member having a protrusion; and a second rotatable member rotatable about the shaft and coupled to the second end of the cable, the second rotatable member having a slot to allow the protrusion to pass through the second rotatable member; and a selector plate rotatable about the shaft and comprising a stop; and an exercise arm to rotate the selector plate in first and second directions, wherein the stop is to engage the protrusion to rotate the first rotatable member when the exercise arm is rotated in the first direction.

2. An exercise apparatus as defined in claim 1, wherein a substantially constant resistance is provided after substantially zero rotation in the first and second directions.

3. An exercise apparatus as defined in claim 1, further comprising a pulley, the cable passing over the pulley to couple the cable to the resistance source.

4. An exercise apparatus as defined in claim 1, wherein the resistance source is a weight stack.

5. An exercise apparatus as defined in claim 1, wherein the exercise apparatus provides bilateral resistance for at least one of a hip flexion exercise, a hip extension exercise, a hip abduction exercise or a hip adduction exercise.

6. An exercise apparatus as defined in claim 1, wherein the exercise apparatus provides bidirectional resistance for at least one of a leg extension exercise or a leg curl exercise.

7. An exercise apparatus as defined in claim 1, wherein the first end of the cable attaches to a first side of the first rotatable member and the second end of the cable attaches to a side of the second rotatable member opposite the first side of the first rotatable member.

8. An exercise apparatus as defined in claim 1, wherein rotation of the exercise arm in the first direction causes the cable to wrap around the first rotatable member to exert a force on the exercise arm.

9. An exercise apparatus as defined in claim 1, further comprising a second stop to prevent the second rotatable member from rotating when the exercise arm is rotated in the first direction.

10. An exercise apparatus as defined in claim 1, wherein the exercise arm comprises a selector pin to cause the selector plate to rotate when the exercise arm is rotated.

11. An exercise apparatus as defined in claim 1, wherein the selector plate comprises a second stop to rotate the second rotatable member when the exercise arm is rotated in the second direction.

12. A bidirectional resistance apparatus for use with an exercise machine, the bidirectional resistance apparatus comprising:

a cable;

a first pulley rotatable about an axis, a first end of the cable attached to the first pulley at a first side of the bidirectional resistance apparatus;

a second pulley rotatable about the axis, a second end of the cable attached to the second pulley at a second side of the bidirectional resistance apparatus:

an exercise arm rotatable about the axis to rotate the first pulley when the exercise arm is rotated in a first direction and to rotate the second pulley when the exercise arm is rotated in a second direction: and a selector plate comprising a first stop, wherein the exercise arm comprises a selector pin to cause the selector plate to rotate about the axis when the exercise arm is rotated, and wherein the first pulley comprises a first protrusion, the first stop to act against the first protrusion to rotate the first pulley when the exercise arm is rotated in the first direction.

13. A bidirectional resistance apparatus as defined in claim 12, wherein the selector plate and the selector pin are to adjust a position of the exercise arm.

14. A bidirectional resistance apparatus as defined in claim 12, further comprising:

a support member;

a second stop attached to the support member to act against a second protrusion of the first pulley to stop the first pulley from rotating when the exercise arm is rotated in the second direction.

15. A bidirectional resistance apparatus as defined in claim 14, further comprising a third stop attached to the support member to act against a third protrusion of the second pulley to stop the second pulley from rotating when the exercise arm is rotated in the first direction.

16. A bidirectional resistance apparatus as defined in claim 14, wherein the second protrusion is located opposite the first protrusion on the first pulley.

17. A bidirectional resistance apparatus as defined in claim 14, wherein the second protrusion is longer than the first protrusion.

18. A bidirectional resistance apparatus as defined in claim 14, wherein the first pulley further comprises a slot to allow a third protrusion of the second pulley to pass through the first pulley.

19. A bidirectional resistance apparatus as defined in claim 18, wherein the selector plate comprises a third stop to act against the third protrusion to rotate the second pulley when the exercise arm is rotated in the second direction.

20. A bidirectional resistance apparatus as defined in claim 12, wherein the first and second pulleys are substantially identical.

21. A bidirectional resistance apparatus as defined in claim 20, wherein the first and second pulleys are mounted in opposite directions.

22. A bidirectional resistance apparatus as defined in claim 12, further comprising:

a resistance source; and a third pulley, the cable passing over the third pulley to couple the resistance source t the exercise arm.

23. A bidirectional resistance apparatus as defined in claim 22, wherein the resistance source is a weight stack.

24. A bidirectional resistance apparatus as defined in claim 12, wherein the apparatus provides a substantially constant resistance to the exercise arm when the exercise arm is rotated in the first and second directions.

25. A bidirectional resistance apparatus as defined in claim 12, wherein the substantially constant resistance is provided after substantially zero rotation in the first and second directions.

* * * * *